US005318019A

United States Patent [19]

Celaya

[11] Patent Number: 5,318,019

[45] Date of Patent: Jun. 7, 1994

[54] EMERGENCY PORTABLE OXYGEN SUPPLY UNIT

[76] Inventor: Marty A. Celaya, 14102 Putnam St.,, Whittier, Calif. 90605

[21] Appl. No.: 853,840

[22] Filed: Mar. 19, 1992

[51] Int. Cl.[5] ..... A62B 9/02

[52] U.S. Cl. ..... 128/204.26; 128/205.24; 128/205.25; 128/207.12; 128/205.12

[58] Field of Search ..... 128/200.24, 201.23, 128/201.28, 203.23, 203.24, 204.18, 205.25, 207.12, 204.26, 201.24, 201.25, 200.23, 205.24, 205.12

[56] References Cited

U.S. PATENT DOCUMENTS

| | | | |
|---|---|---|---|
| 2,087,119 | 7/1937 | Rosenow | 128/205.25 |
| 3,186,407 | 6/1965 | Morrison | 128/205.25 |
| 3,202,150 | 8/1965 | Miller | 128/205.25 |
| 3,762,407 | 10/1973 | Shonerd | 128/201.23 |
| 4,221,216 | 9/1980 | Kranz | 128/201.23 |
| 4,331,141 | 5/1982 | Pokhis | 128/205.25 X |
| 4,440,163 | 4/1984 | Spergel | 128/205.25 |
| 4,452,240 | 6/1984 | Moretti | 128/201.23 X |
| 4,508,115 | 4/1985 | Warncke | 128/201.23 |
| 4,534,344 | 8/1985 | Constance-Hughes | 128/201.15 |
| 4,549,541 | 10/1985 | Sundahl | 128/201.19 |
| 4,582,054 | 4/1986 | Ferrer | 128/200.23 |
| 4,664,107 | 5/1987 | Wass | 128/200.23 |
| 4,669,462 | 6/1987 | Marshall | 128/205.25 |
| 4,702,243 | 10/1987 | Smith | 128/205.24 |
| 4,802,472 | 2/1989 | Jung | 128/204.18 |
| 4,928,686 | 5/1990 | Nelepka | 128/205.24 |
| 5,007,421 | 4/1991 | Stewart | 128/204.18 |
| 5,099,835 | 3/1992 | Nelepka | 128/204.18 |

FOREIGN PATENT DOCUMENTS

| | | | |
|---|---|---|---|
| 241188 | 10/1987 | European Pat. Off. | 128/201.25 |
| 1031138 | 5/1958 | Fed. Rep. of Germany | 128/200.21 |
| 324415 | 2/1935 | Italy | 128/201.25 |
| 1570065 | 6/1980 | United Kingdom | 128/204.26 |

*Primary Examiner*—Edgar S. Burr
*Assistant Examiner*—Eric P. Raciti
*Attorney, Agent, or Firm*—Edgar W. Averill, Jr.

[57] ABSTRACT

An emergency portable oxygen supply unit for use in assisting a person to breath in an oxygen depleted environment such as that present within a structure during a structural fire. The unit has a face mask affixed to a housing which also supports an air filter and a source of pure oxygen. As the person wearing the air mask inhales, a flapper valve within the housing opens an oxygen valve and allows pure oxygen to be mixed with air which has passed through the air filter thereby providing breathable air.

7 Claims, 2 Drawing Sheets

FIG. 3
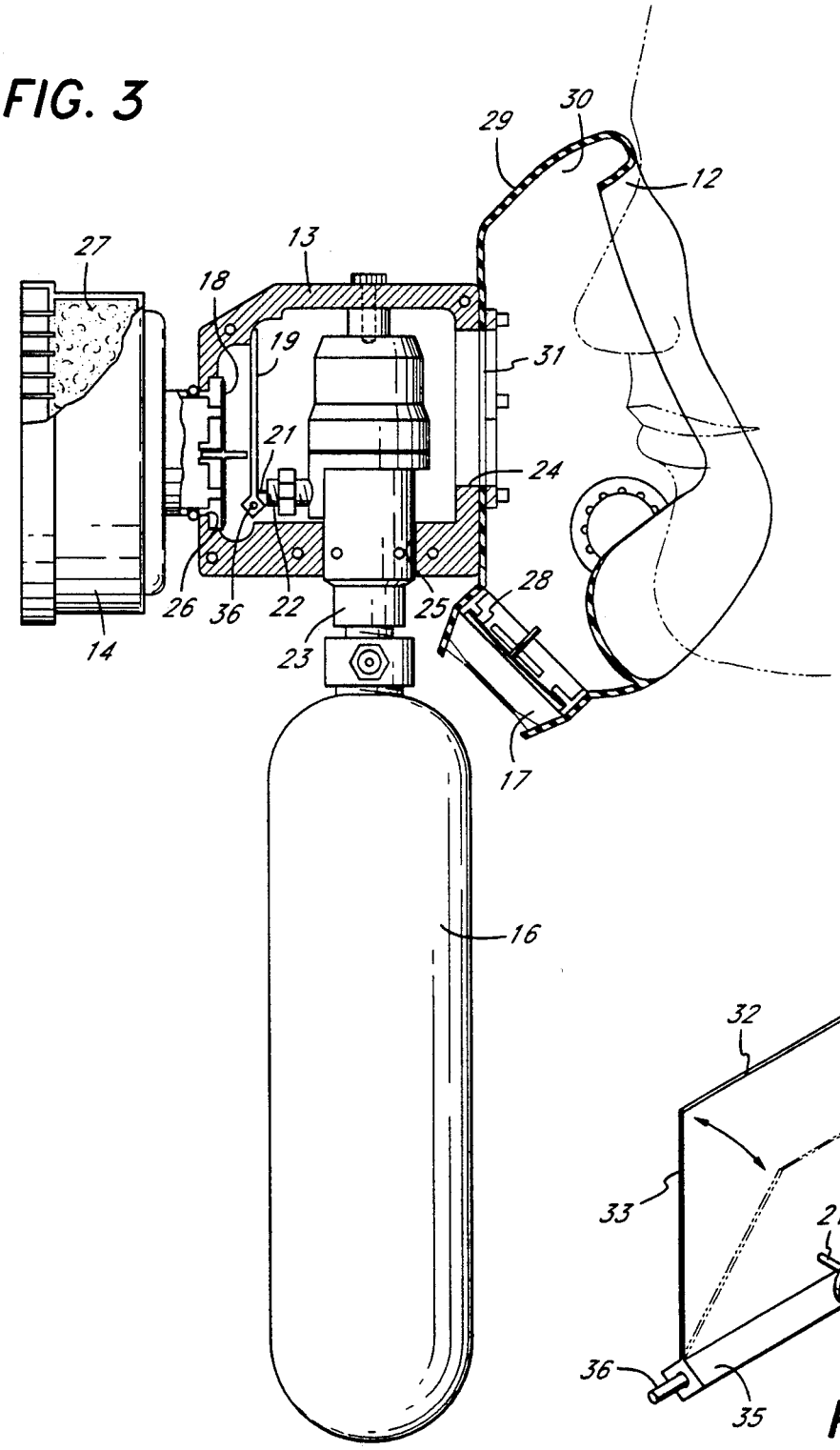
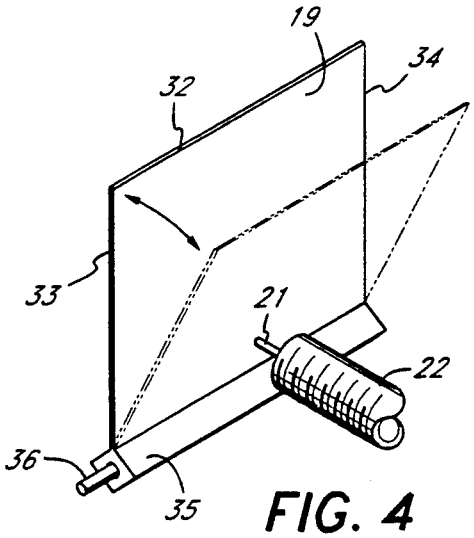
FIG. 4

EMERGENCY PORTABLE OXYGEN SUPPLY UNIT

BACKGROUND OF THE INVENTION

The field of the invention is fire safety devices, and the invention relates more particularly to devices which provide oxygen for use in oxygen depleted environments.

During a structural fire, a major cause of death is the lack of breathable air within the burning structure. Often the heat is not a major cause of injury, and if a person were to have a source of oxygen, that person could escape without injury. While expensive, cumbersome and elaborate oxygen supplying units are available for fire fighters, it is not practicable for untrained persons to use such devices in an emergency environment. Furthermore, the cost of such units would be prohibitive for supplying them as a preventative safety device.

SUMMARY OF THE INVENTION

It is an object of the present invention to provide an oxygen supplying unit which is intuitive to use, low in cost and sufficient to provide life-saving oxygen in the interior of a structure during a structural fire.

The present invention is for an emergency portable oxygen supply unit for use in assisting a person to breathe in an oxygen depleted environment. The unit has a face mask with a flexible face-contacting opening, and the face mask is connected to a hollow housing. The hollow housing also has an air filter opening which permits filter air to pass within the housing. Thirdly, the housing has an oxygen opening which is controlled by a valve which, in turn, is operated by a flapper. In use, the user places the face mask over his or her face and inhales. The air flows through the air filter into the housing, and in so doing moves a flapper which introduces pure oxygen into the interior of the housing. The pure oxygen mixes with the filtered air and provides a breathable gas for the wearer. The unit is light in weight and is capable of providing up to about eight to ten minutes of breathable air sufficient to permit him to escape the hostile environment.

BRIEF DESCRIPTION OF THE DRAWINGS

FIG. 3 is an enlarged side view partly in cross-section of the emergency portable oxygen supply unit of FIG. 11.

FIG. 4 is a perspective view of the flapper of the emergency portable oxygen supply unit of FIG. 1

DESCRIPTION OF THE PREFERRED EMBODIMENTS

Figure 2:
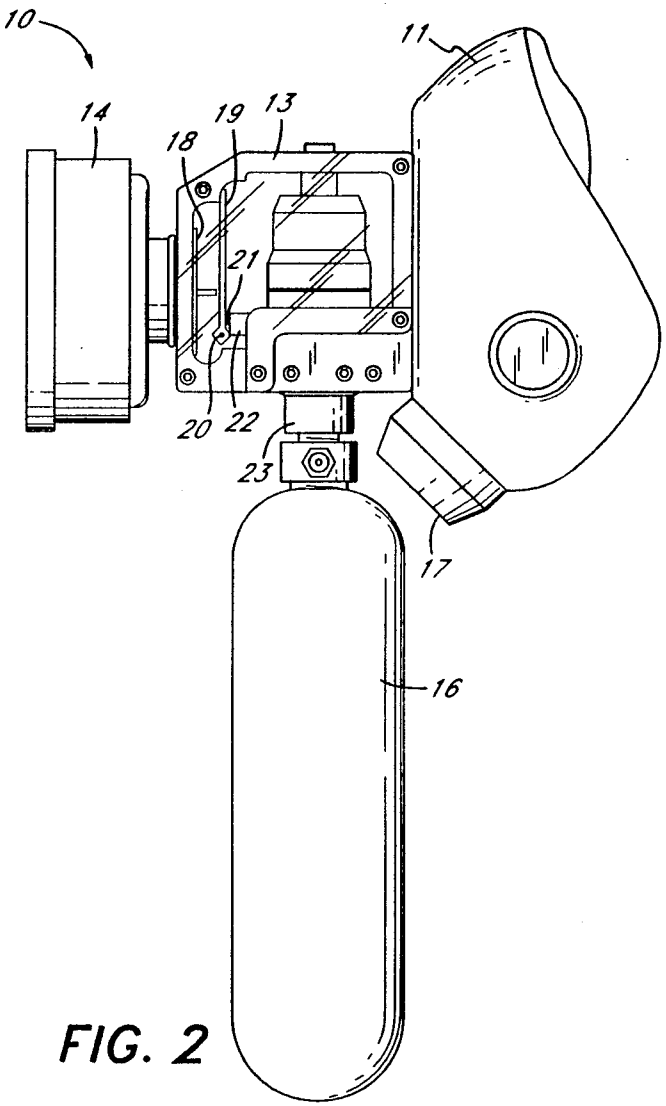
FIG. 2 is a side view of the emergency portable oxygen supply unit of FIG. 1.
Figure 1:
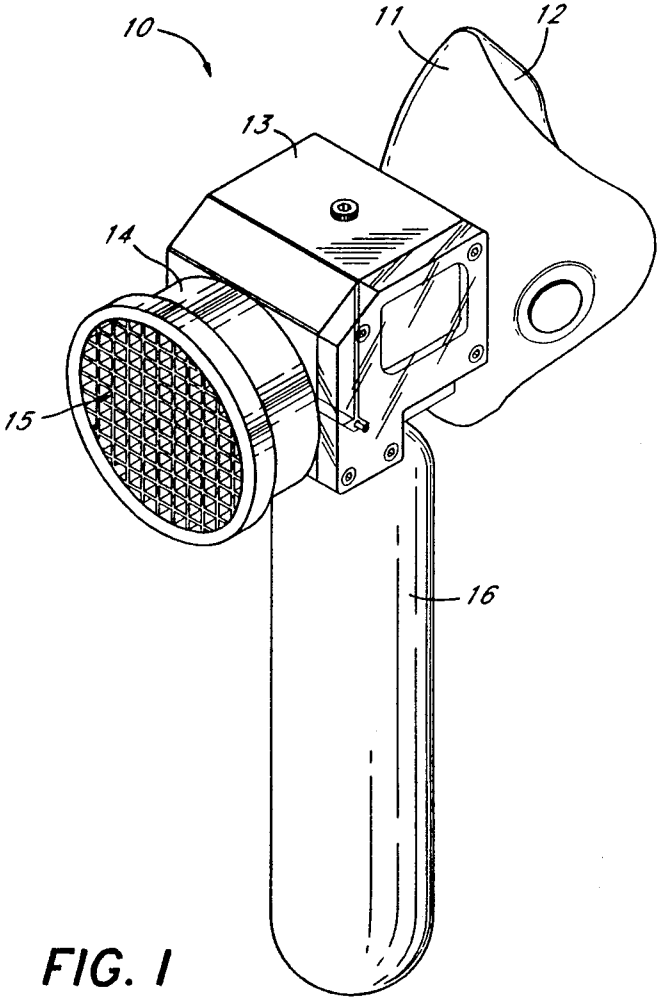
FIG. 1 is a perspective view of the emergency portable oxygen supply unit of the present invention.

An emergency portable oxygen supply unit is shown in perspective view in FIG. 1 and indicated by reference character 10. Unit 10 has a face mask 11 with a flexible face-contacting opening 12. Face mask 11 is held in an airtight manner to a hollow housing 13 shown best in FIG. 3. An air filter 14 is affixed across another opening in hollow housing 13 and has an air inlet 15 which provides filter air to the interior of housing 13 and, thus, to the interior of the face mask 11. An oxygen container 16 is held below hollow housing 13 and supplies pure oxygen to the interior of housing 13 which is mixed with air which is passed through air filter 14. Face mask 11, as shown in FIG. 2, has an air exhaust fitting 17 which is equipped with one-way valve 28 shown best in FIG. 3. This one-way valve, of course, allows air to escape through air exhaust 17, but shuts off the inlet of air when the wearer inhales. When the wearer inhales, a second one-way valve 18 opens and allows air to pass inwardly through air filter 14 into the hollow housing 13 and, thus, into the face mask.

As air moves through air filter 14 through valve 18, it contacts flapper 19 moving it rearwardly. Flapper 19 is hinged at 20, and the stem 21 of Schrader valve 22 is thus retracted opening Schrader valve 22 permitting oxygen to enter the interior of housing 13. This oxygen mixes with the gas or filtered air which is passed through filter 14 providing a oxygen-enriched air flow to the user. The oxygen within oxygen container 16 is preferably high-pressure oxygen, the pressure of which is reduced by a pressure regulator 23 before it reaches Schrader valve 22.

Turning now to FIG. 3, hollow housing 13 can be seen to have a mask opening 24, an oxygen valve opening 25 and an air filter opening 26. The filter medium 27 within air filter 14 is preferably an activated charcoal based filter which tends to absorb irritating gasses.

The details of the second one-way valve 18 are shown in FIG. 3 as are the details of the first one-way valve 28. The face mask 11 has an exterior surface 29 and an interior surface 30 which extends to an air intake opening 31 which is sealed in a conventional manner over mask opening 24.

The flapper 19 is shown in perspective view in FIG. 4 and can be seen to have a generally rectangular shape with a top 32, sides 33 and 34 and a bottom 35 which supports a hinge pin 36. This causes the valve to move rearwardly, as shown in phantom view in FIG. 4, as the user inhales. A flow of oxygen then passes into the interior of housing 13 and mixes with the filtered air as set forth above. Of course, as the user exhales, the second one-way valve 18 closes, and the first one-way valve 28 opens allowing the user to exhale through the base of the mask in a conventional manner.

Preferably, the unit will be supplied with a pressure gauge to permit safety personnel to be assured that there has been no leak and that there is still high-pressure oxygen within container 16. Also, a conventional on/off valve would be supplied at the neck of container 16 so that it may be removed and replaced without the escape of any remaining oxygen.

The unit of the present invention is low in cost, light in weight and very easy to use. It can be supplied to untrained personnel who instinctively will place it over their nose and mouth and inhale, thus automatically activating the unit. The Schrader valve 22 has sufficient spring tension in its stem to hold the flapper 19 in an upright position, as viewed in Figure 3, thus preventing the escape of any oxygen when the mask is not in use. By widely supplying such masks, it is believed that a significant savings in life can be accomplished.

While the present invention has been discussed as a safety device, it, of course, can supply oxygen in other environments and is not limited strictly to fire hazards. For instance, chemical leaks or other hazardous gas leaks could be negated by the wearing of the portable oxygen supply unit of the present invention. Of course, the composition of filter medium 27 would be adjusted for the particular intended use.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An emergency portable oxygen supply unit for use in assisting a person to breathe in an oxygen depleted environment such as that present within structure during a structural file, said unit comprising:

a face mask having a flexible face-contacting opening, an interior surface and an exterior surface, a first one-way air valve to permit air to escape from the interior of the face mask to the exterior thereof and an air intake opening;

a hollow housing having a mask opening of which the air intake opening of said face mask is affixed, an oxygen valve opening and an air filter opening, said air filter opening being through a second one-way valve which permits air to enter the hollow housing but prohibits air from exiting therethrough; and an air flow path within said hollow housing between said air filter opening and said mask opening;

air filtration means affixed to said air filter opening, said air filtration means including a filter medium;

an oxygen valve assembly held by said hollow housing over said oxygen valve opening, said oxygen valve having a flapper positioned in said air flow path so that the air entering said air filtration means must flow around said flapper and said flapper contacting a valve stem so that when the flapper is moved away from said air filter opening by the flow of air in the air flow path, the oxygen valve is opened, said flapper and valve stem being biased so that when there is no air flow in said air flow path, the oxygen valve is closed, and said oxygen valve having an oxygen inlet fitting; and an oxygen container affixed to the inlet fitting of said oxygen valve and said oxygen container, when filled with oxygen, will pass oxygen gas into the interior of said hollow housing when the face mask is placed on the user's nose and mouth and the user inhales thereby mixing oxygen with the filtered air which passes through the air filter and into the hollow housing.

2. The emergency portable oxygen supply unit of claim 1 further including a pressure regulator between said oxygen container and said oxygen valve to regulate and limit the flow of oxygen through said oxygen valve when it is open.

3. The emergency portable oxygen supply unit of claim 2 wherein said flapper is a rigid plate hingedly affixed to said hollow housing near an edge of said flapper and said valve stem being a biased stem having an outer contact point touching the surface of said flapper.

4. The emergency portable oxygen supply unit of claim 3 wherein said valve stem touches said flapper near the point where it is hingedly held to said hollow housing.

5. The emergency portable oxygen supply unit of claim 4 wherein said flapper is a rectangular unit having a bottom, two sides and a top, and said flapper being hinged along one edge.

6. The emergency portable oxygen supply unit of claim 5 wherein said flapper is hinged along its bottom edge.

7. An emergency portable oxygen supply unit for use in assisting a person to breathe in an oxygen depleted environment such as that present within a structure during a structural fire, said unit comprising:

a face mask having a flexible face-contacting opening, an interior surface and an exterior surface, a first one-way air valve to permit air to escape from the interior of the face mask to the exterior thereof and an air intake opening;

a hollow housing having a mask opening to which the air intake opening of said face mask is affixed, an oxygen valve opening and an air filter opening, said air filter opening being through a second one-way valve which permits air to enter the hollow housing but prohibits air from exiting therethrough and an air-flow path within said hollow housing between said air filter opening and said mask opening;

air filtration means affixed to said air filtration opening, said air filter means including a filter medium;

an oxygen valve assembly held by said hollow housing over said oxygen valve opening, said oxygen valve having a rigid flapper supported by a hinge and positioned in said air-flow path so that air entering said air filtration means must flow around said flapper and said mask opening and said flapper contacting a valve stem near said hinge so that when the flapper is hingedly moved away from said air filter opening by the flow of air in the air flow path, the valve stem is moved so that the oxygen valve is opened, said flapper and valve stem being biased so that when there is no air flow in said flow path, the oxygen valve is closed and said oxygen valve having an oxygen inlet fitting and said oxygen valve having an oxygen outlet located centrally within the air flow path between said air filtration means and said mask opening so that oxygen will mix with gasses passing through said hollow housing; and an oxygen container affixed through a pressure regulator to the inlet fitting of said oxygen valve and said oxygen container, when filled with oxygen, will pass oxygen gas into the interior of said hollow housing when the face mask is placed over the user's nose and mouth and the user inhales thereby mixing oxygen with the filtered air which passes through the air filter and into the hollow housing.

* * * * *